US012553248B2

(12) United States Patent
McDaniel et al.

(10) Patent No.: US 12,553,248 B2
(45) Date of Patent: Feb. 17, 2026

(54) SYSTEMS AND METHODS FOR SECURING CONSTRUCTION SITE SCAFFOLDING

(71) Applicant: Bechtel Energy Inc., Houston, TX (US)

(72) Inventors: Adam McDaniel, Sugar Land, TX (US); Robert Hurd, Houston, TX (US); Ben Pletcher, Houston, TX (US)

(73) Assignee: Bechtel Equipment Operations, Inc., Sugar Land, TX (US)

( * ) Notice: Subject to any disclaimer, the term of this patent is extended or adjusted under 35 U.S.C. 154(b) by 88 days.

(21) Appl. No.: 18/473,006

(22) Filed: Sep. 22, 2023

(65) Prior Publication Data

US 2024/0102298 A1 Mar. 28, 2024

Related U.S. Application Data

(60) Provisional application No. 63/409,502, filed on Sep. 23, 2022.

(51) Int. Cl.
*E04G 5/04* (2006.01)
*E04G 3/20* (2006.01)
*E04G 3/24* (2006.01)

(52) U.S. Cl.
CPC ..... *E04G 5/046* (2013.01); *E04G 3/20* (2013.01); *E04G 3/246* (2013.01)

(58) Field of Classification Search
CPC .. E04G 5/046; E04G 5/04; E04G 3/20; E04G 3/246
USPC ..... 248/205.1
See application file for complete search history.

(56) References Cited

U.S. PATENT DOCUMENTS 2,245,939 A 6/1941 Schiller
3,905,572 A * 9/1975 Hikai ..... E04G 5/04 248/242
3,955,644 A * 5/1976 Steele ..... E04G 7/30 182/186.7
4,140,414 A * 2/1979 Buttgereit ..... E04B 1/585 403/374.2
4,290,576 A * 9/1981 Schworer ..... E04G 11/28 249/20
4,382,571 A 5/1983 Horen
4,961,478 A * 10/1990 Anderson ..... E04G 5/046 248/245
6,203,236 B1 * 3/2001 Gautier ..... G05G 1/46 403/321

(Continued)

FOREIGN PATENT DOCUMENTS

DE 8400573 U1 4/1984
DE 3712676 A1 10/1988

(Continued)

OTHER PUBLICATIONS

Karl Rodriguez; International Search Report and Written Opinion for PCT/US23/77149; Mar. 15, 2024; 10 pages; United States Patent and Trademark Office as the International Search Authority; Alexandria, VA.

(Continued)

*Primary Examiner* — Nkeisha Smith
(74) *Attorney, Agent, or Firm* — William P. Jensen; Crain Caton & James, P.C.

(57) ABSTRACT

A scaffold securing device and methods for securing conventional scaffolding to a linear or a curvilinear surface.

20 Claims, 7 Drawing Sheets

(56) References Cited

U.S. PATENT DOCUMENTS

| | | | | |
|---|---|---|---|---|
| 7,475,856 | B2 | 1/2009 | Riblet | |
| 9,217,255 | B2 * | 12/2015 | Mork | E04G 3/28 |
| 9,556,626 | B2 * | 1/2017 | Mork | E04G 3/243 |
| 10,174,512 | B2 * | 1/2019 | Van Oers | E04G 3/28 |
| 10,865,575 | B2 * | 12/2020 | Schmid | F16M 13/022 |
| 11,549,274 | B2 * | 1/2023 | Black | E04G 5/045 |
| 2006/0175130 | A1 * | 8/2006 | Riley | E04G 5/00 182/82 |
| 2008/0179477 | A1 * | 7/2008 | Harney | E04G 5/04 248/238 |

FOREIGN PATENT DOCUMENTS

| | | | |
|---|---|---|---|
| JP | 2015068032 | A | 4/2015 |
| KR | 20080108205 | | 12/2008 |

OTHER PUBLICATIONS

Josh Skroupa; International Preliminary Report on Patentability for PCT App. No. PCT/US23/77149; Jun. 20, 2024; 7 pages; United States Patent and Trademark Office as the International Preliminary Examination Authority; Alexandria, VA.

Dorota Dornowska; Preliminary Assessment for Polish App. No. P.451774; Oct. 29, 2025; 8 pages; The Patent Office of the Republic of Poland; Warsaw Poland (machine translation and original).

* cited by examiner

SYSTEMS AND METHODS FOR SECURING CONSTRUCTION SITE SCAFFOLDING

RELATED APPLICATIONS

This application claims priority to U.S. Provisional Application No. 63/409,502, filed Sep. 23, 2022, which is incorporated herein by reference.

FIELD OF THE DISCLOSURE

The present disclosure generally relates to systems and methods for securing construction site scaffolding. More particularly, the systems and methods utilize a unique scaffolding anchor to secure conventional scaffolding to a linear surface or different curvilinear surfaces.

BACKGROUND

Historically, tank builders pre-assembled, erected, and jumped their own scaffold system. This work process required additional site training and an expert to physically check and green tag the scaffold system. This division of labor is not optimized, and two separate crews must validate the readiness of the same scaffold. It is also common to see beam clamp type connections for most hanging scaffold systems. These usually are fixed, built-in place, in part or in whole, and are not easily moved once green tagged and put in use. Disadvantages include the tonnages required to achieve worker access to the various work fronts throughout the life of a project.

Customized scaffold systems are also common in tank erection. Typically, the customized scaffold system interfaces with a welded steel attachment. One disadvantage is that the scaffold is typically customized for curved steel plate structures and is not normally used for any other type of construction commodity (i.e., civil, structural steel, concrete work, etc.). The fabrication costs are thus higher for this type of scaffold system. Field erected tanks that are over three rings in height (approx. 30 ft) require specialized access that: i) provides worker access/egress at the work front; and ii) provides tank shell wind protection, which prevents the tank shell from blowing inward during high winds. These scaffolds are highly customized, costly and vary in design across tank projects (i.e., FETs, LNGs, Spheres).

BRIEF DESCRIPTION OF THE DRAWINGS

The detailed description is described below with reference to the accompanying drawing, in which like elements are referenced with like reference numbers, and in which.

DETAILED DESCRIPTION OF THE ILLUSTRATIVE EMBODIMENTS

Figure 1:
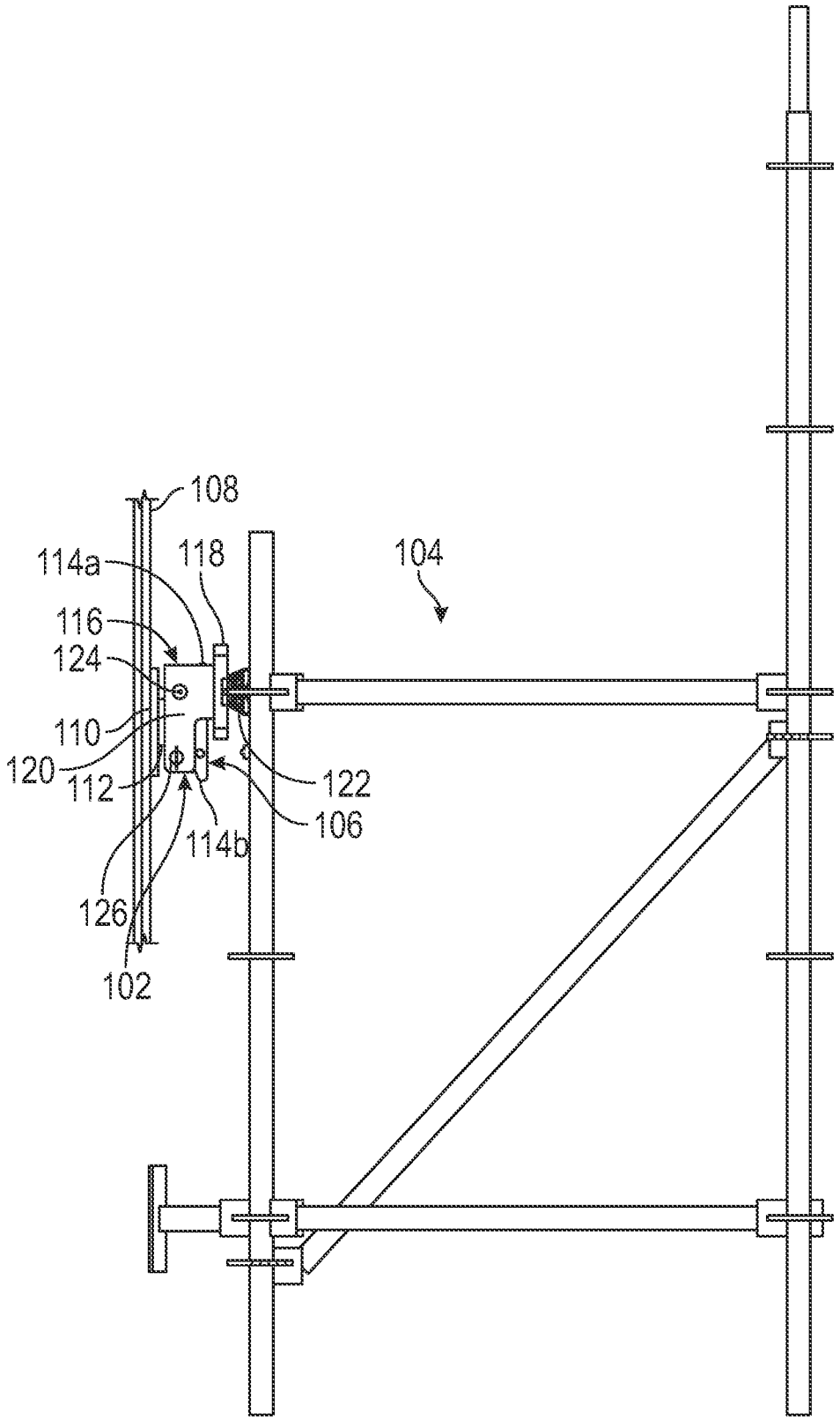
FIG. 1 is an elevation view illustrating one embodiment of a scaffold securing device, according to the present disclosure, attached to a conventional scaffold.

The subject matter of the present disclosure is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

The systems and methods disclosed herein overcome the prior art disadvantages associated with conventional scaffold systems, which require customization for tank construction and thus, are not adapted for use on other construction projects. The systems and methods overcome the prior art disadvantages by using a unique scaffold securing device to secure conventional scaffolding to a linear surface or different curvilinear surfaces. The systems and methods may be used on various permanent plant structures during site construction activities so that the scaffold system components may be attached strategically and timely at the work fronts.

In one embodiment, the present disclosure includes a scaffold securing device comprising: i) a base adapted to be secured to a fixed surface, the base having a planar face and a support member substantially perpendicular to the planar face, the support member forming an upper extension at a predetermined distance from the planar face; ii) a coupler for temporarily coupling the scaffold to the base, the coupler having a planar face, a first restraining side, a second restraining side and an adapter affixed to the planar face for temporarily securing the coupler to the scaffold, the first restraining side and the second restraining side being substantially perpendicular to the planar face and separated by a support member fixed between the first restraining side and the second restraining side for supporting the coupler on the support arm member of the base and a removable restraining arm coupled to the first restraining side and the second restraining side below the support arm for enabling coupling and decoupling between the scaffold and the base; and iii) wherein the securing device enables movement between the base and the coupler for securing the scaffold to a linear surface or different curvilinear surfaces.

In another embodiment, the present disclosure includes a method for securing a scaffold, comprising: i) securing a base to a fixed curvilinear surface; ii) securing a coupler to the scaffold, the coupler having a planar face, a first restraining side, a second restraining side and an adapter affixed to the planar face for securing the coupler to the scaffold; and iii) coupling the scaffold to the base with the coupler by adjusting the coupler based on the fixed curvilinear surface while the scaffold is coupled to the base.

Figure 2:
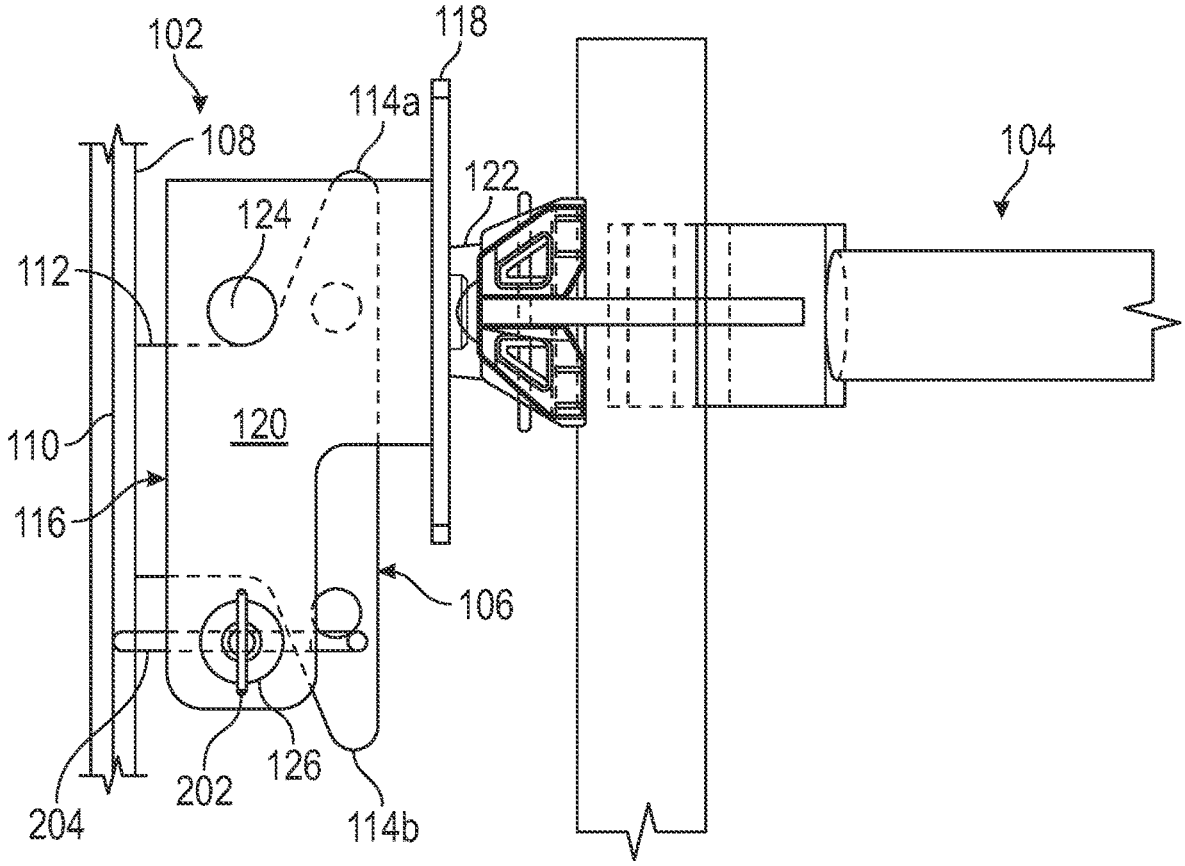
FIG. 2 is an enlarged view of the scaffold securing device in FIG. 1.
Figure 3:
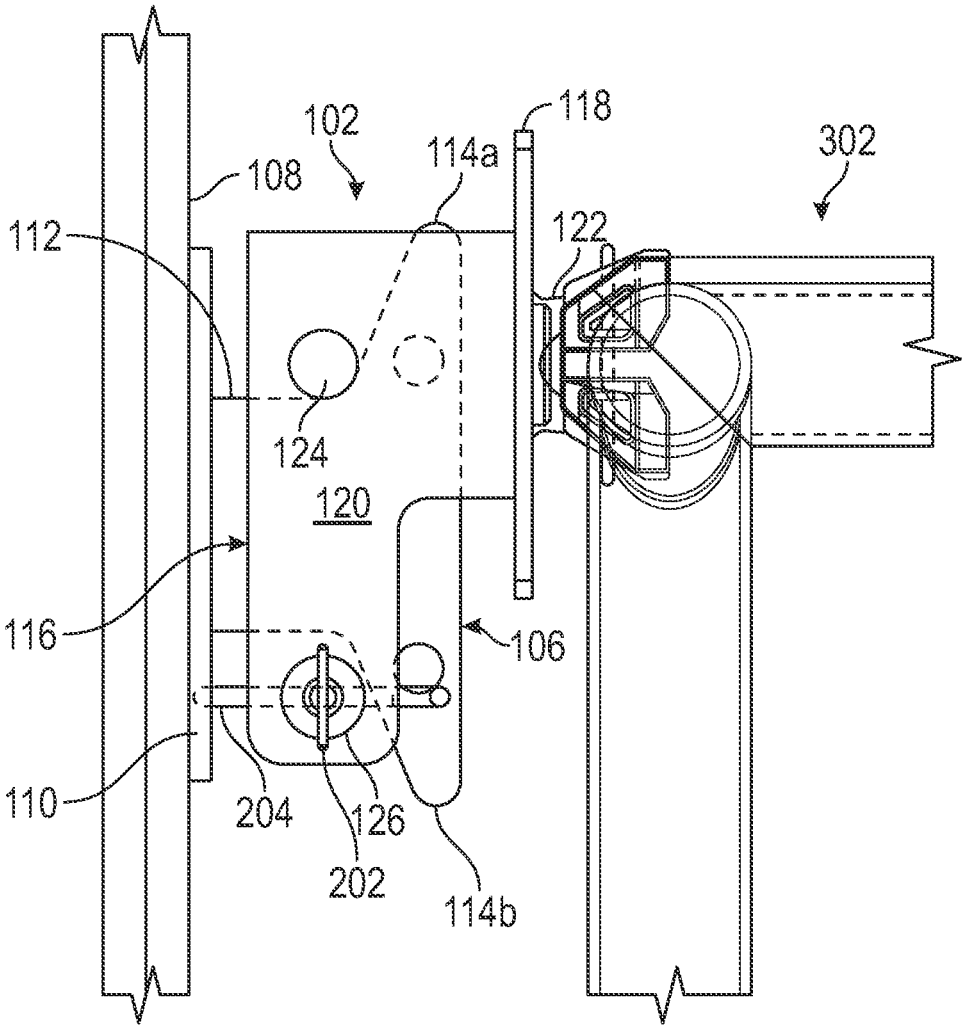
FIG. 3 is an enlarged view of the scaffold securing device in FIG. 1 illustrating it attached to a different conventional scaffold.

Referring now to FIGS. 1-9, a scaffold securing device 102 is attached to a conventional scaffold system 104 in FIGS. 1-2 and a different conventional scaffold system 302 in FIG. 3. The scaffold securing device 102 includes a base 106 adapted to be secured to a fixed surface 108 by, for example, welding portions of a planar face 110 on the base 106 to the fixed surface 108. The base 106 has a support member 112 substantially perpendicular to the planar face 110. The support member 112 forms an upper extension 114*a* and a lower extension 114*b* at a predetermined distance 902 from the planar face 110. The scaffold securing device 102 further includes a coupler 116 for temporarily coupling the scaffold system 104 to the base 106. The coupler 116 has a planar face 118, a first restraining side 120, a second restraining side 502 (FIG. 5) and an adapter 122 affixed to the planar face 118 by, for example, welding for temporarily securing the coupler 116 to the scaffold system 104. The adapter 122 may comprise any shape capable of supporting and securing the scaffold system 104 such as, for example, a hook or a clip. The first restraining side 120 and the second restraining side 502 are substantially perpendicular to the planar face 118 and are separated by a support arm 124 fixed between the first restraining side 120 and the second restraining side 502 for supporting the coupler 116 on the support member 112 of the base 106. The first restraining side 120 and the second restraining side 502 are also separated by a removable restraining arm 126 coupled to the first restraining side 120 and the second restraining side 502 below the support arm 124 for enabling coupling and decoupling between the scaffold system 104 and the base 106.

The upper extension 114*a* and the lower extension 114*b* of the support member 112 form a combined length 904 that is longer than a distance 704 between the support arm 124 and the restraining arm 126 of the coupler 116 for limiting movement of the coupler 116 away from the base 106 and maintaining coupling between the scaffold system 104 and the base 106. The support member 112 extends the predetermined distance 902 away from and substantially perpendicular to the planar face 110 to enable sufficient movement between the base 106 and the coupler 116. Likewise, the first restraining side 120 and the second restraining side 502 are spaced apart a predetermined distance 706 to enable sufficient movement between the base 106 and the coupler 116. In this manner, the scaffold securing device 102 enables sufficient movement between the base 106 and the coupler 116 for securing the scaffold system 104 to a linear surface or different curvilinear surfaces wherein the different curvilinear surfaces may include cylindrical surfaces and spherical surfaces.

The removable restraining arm 126 may be coupled to the first restraining side 120 and the second restraining side 502 by passing the removable restraining arm 126 through an opening in the first restraining side 120 and an opening in the second restraining side 502. A cotter pin 202 passing through an opening at one end of the removable restraining arm 126 completes the coupling. The removable restraining arm 126 may be easily positioned by use of a handle 204 at another end opposite the one end of the removable restraining arm 126 with the opening.

Figure 4:
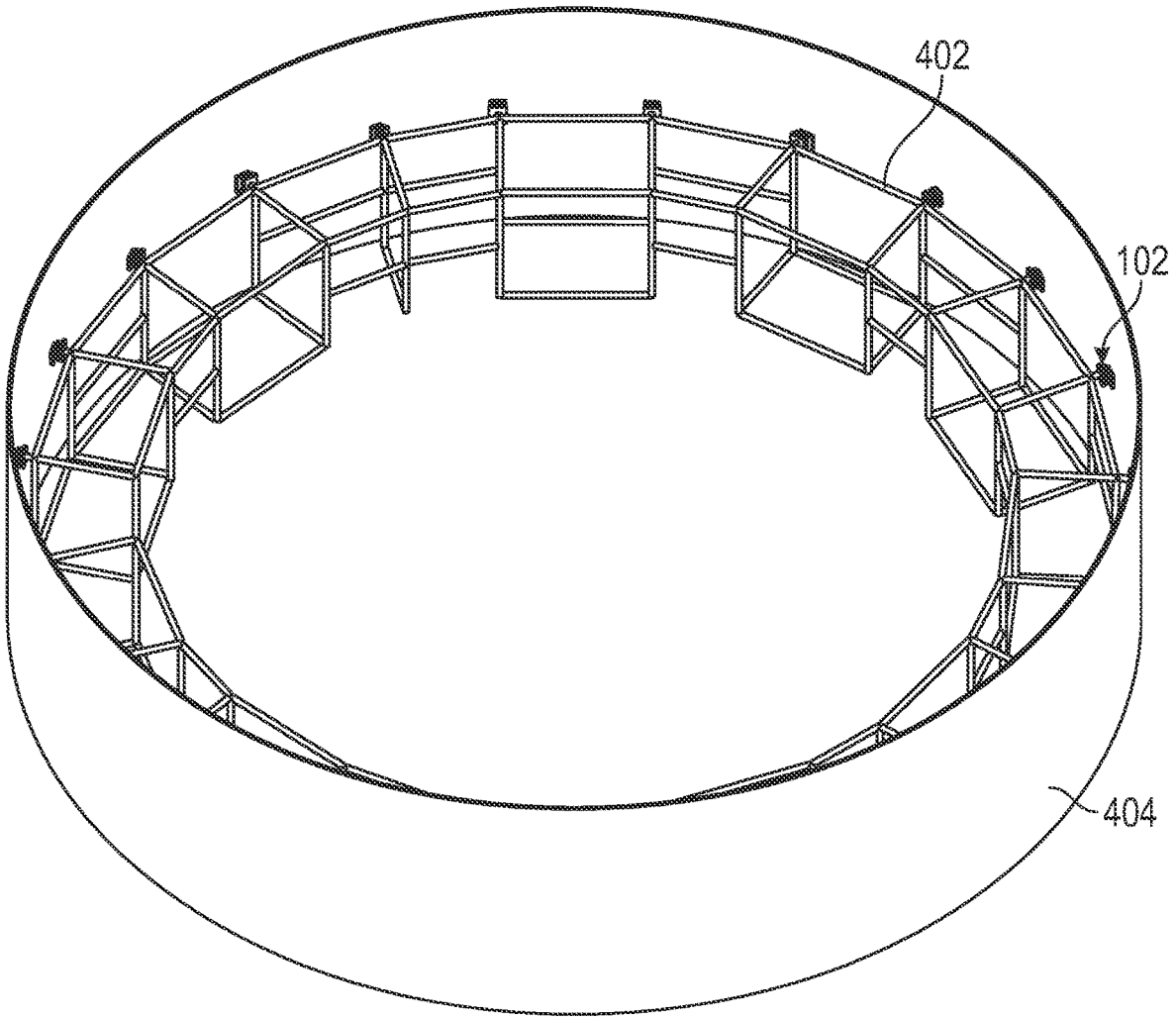
FIG. 4 is a perspective view illustrating a conventional scaffold secured to a curvilinear surface by the scaffold securing device in FIG. 1.
Figure 5:
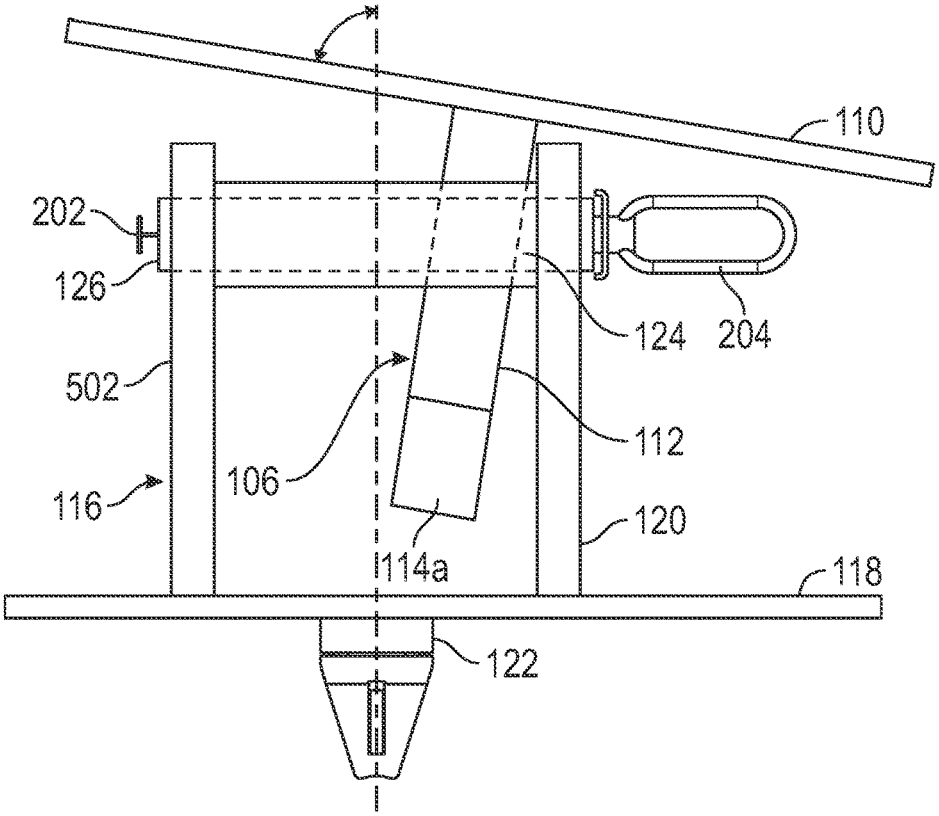
FIG. 5 is a top view of the scaffold securing device in FIG. 1 illustrating adjustment of the coupler.
Figure 6:
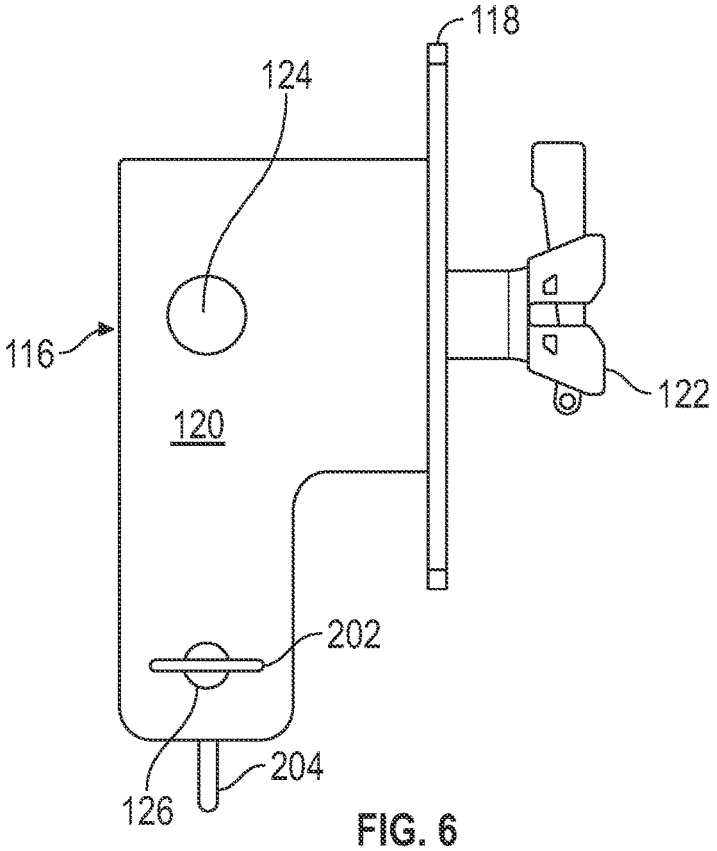
FIG. 6 is a side view of the coupler illustrated in FIG. 1 as part of the scaffold securing device.
Figure 7:
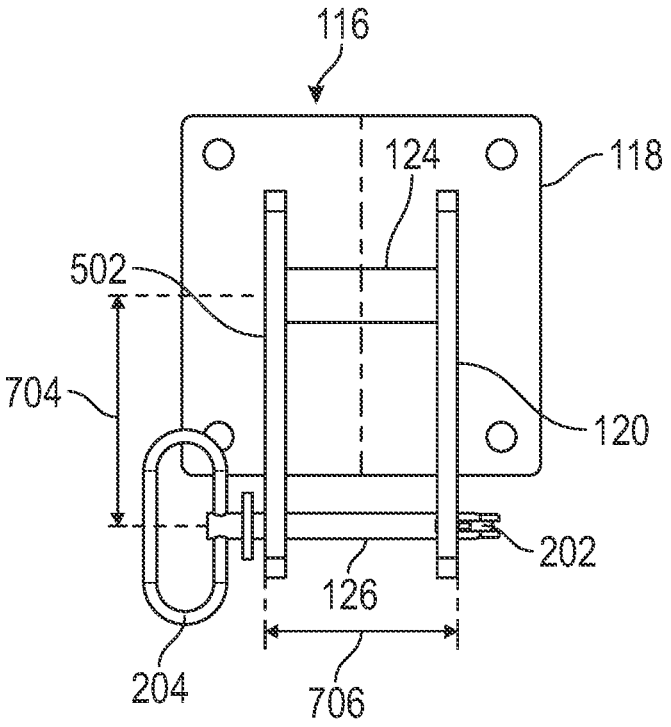
FIG. 7 is a front view of the coupler illustrated in FIG. 1 as part of the scaffold securing device.
Figure 8:
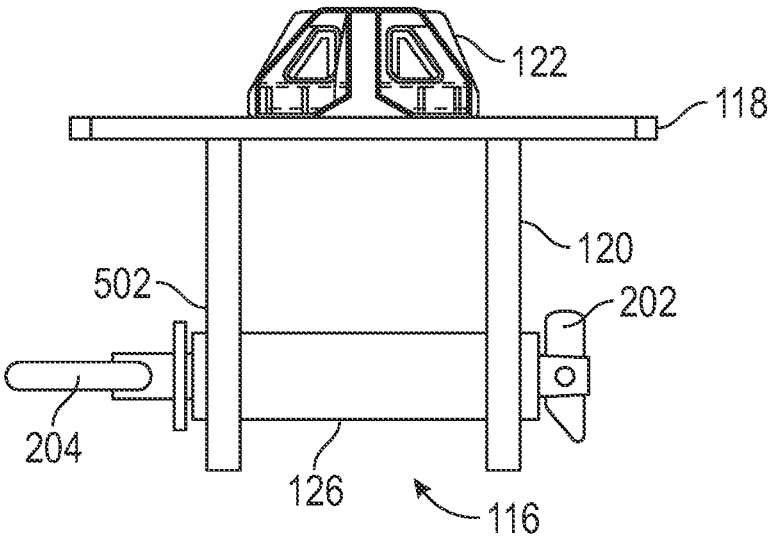
FIG. 8 is a bottom view of the coupler illustrated in FIG. 1 as part of the scaffold securing device.
Figure 9:
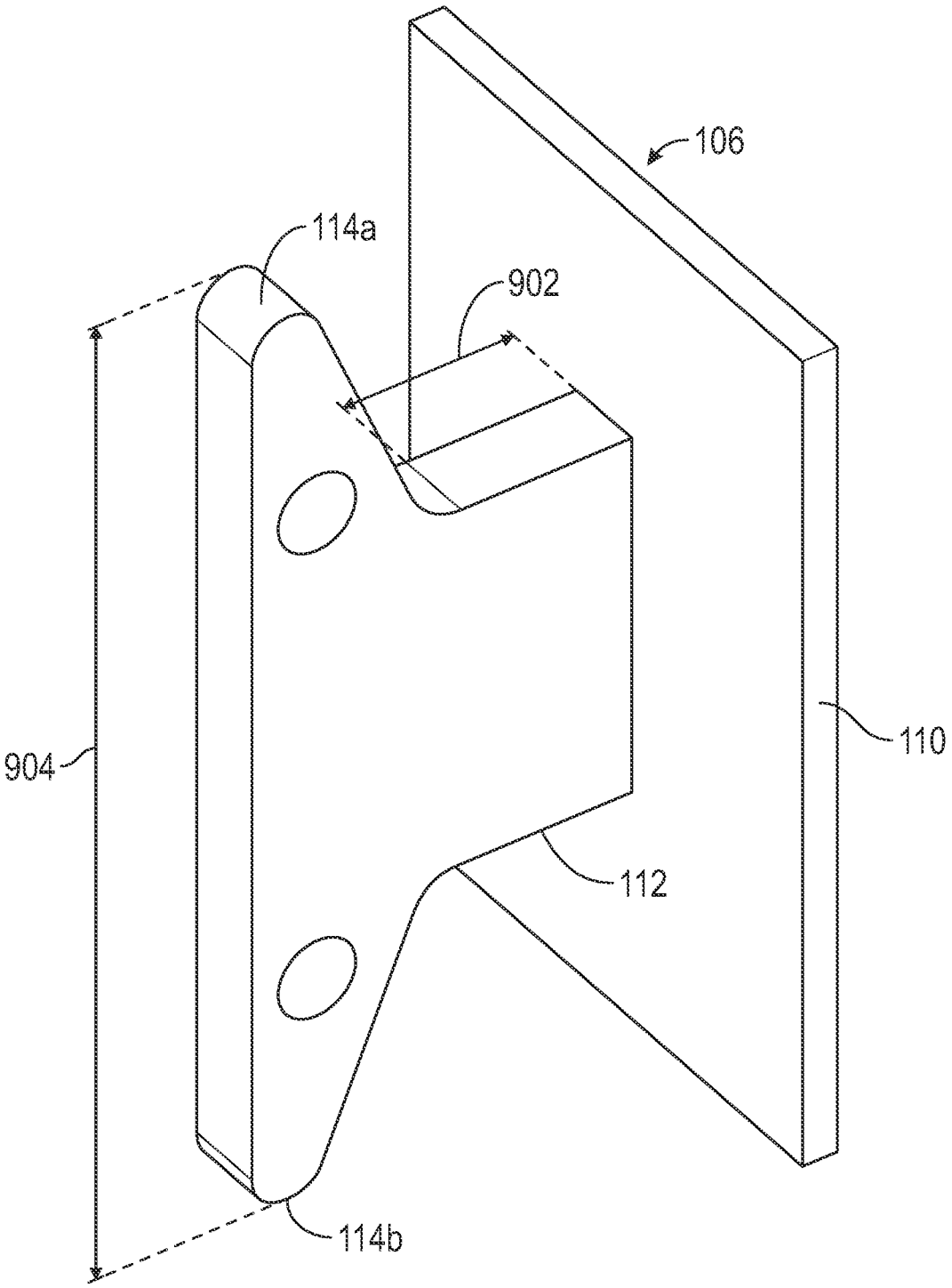
FIG. 9 is a perspective view of the base illustrated in FIG. 1 as part of the scaffold securing device.

The scaffold securing device 102 may be used to secure a conventional scaffold system 402 to a fixed curvilinear surface 404 (e.g., a tank) as illustrated in FIG. 4. The base 106 is first secured to the fixed curvilinear surface 404 by, for example, welding portions of the planar face 110 on the base 106 to the fixed curvilinear surface 404. The coupler 116 may then be secured to the scaffold system 402 using the adapter 122. The scaffold system 402 may then be coupled to the base 106 with the coupler 116 by adjusting the coupler 116 based on the fixed curvilinear surface 404 while the scaffold system 402 is coupled to the base 106. Preferably, the scaffold system 402 is coupled to the base 106 above a ground surface. As illustrated in FIG. 5, the coupler 116 may be easily adjusted while the scaffold system 402 is coupled to the base 106 above a ground surface by simply moving the coupler 116 on the base 106. The scaffold securing device 102 may thus, be used to secure a conventional scaffold system 402 to the inside or outside of any fixed curvilinear surface.

The systems and methods disclosed herein, therefore, allow conventional scaffold systems to be supported at or above elevation on linear and curvilinear surfaces with the following jobsite benefits: i) adaptability (may be attached to various structures including curved steel walls (interior or exterior), structural steel columns/beams and concrete embeds); and ii) flexibility (install/remove pre-assembled/modular scaffold units and install at elevation 1, 2, . . . or install at elevation 1 and roll to next position at same elevation). Additionally, the increased mobility enables planning for reduced scaffold materials/tonnage and the scaffold can be moved to the next work front if not working concurrently. This saves on material, labor, and provides additional room/clearance at the jobsite to work separate crews or stage alternative materials or equipment.

Additional benefits may include i) Health and Safety—mature technology, high core competencies exist in management and field deployment; ii) Quality—mature technology, parts are mass manufactured with mature supply chain QA/QC, and SQ processes in place; iii) Productivity—improved EPC synergy across the entire process of scoping, specifying, shipping, erecting, demobilizing scaffolding materials for field erected tank work fronts; iv) Increased Digital—change in physical technology enables tracking with existing advanced analytic tools (e.g., power BI, telematics, material tracking, etc.) and plate structures may be added to the digital tracking systems in place; v) Future Readiness—readiness deliverables include: (a) scoping guideline enables straight forward scoping and specifying the technology for projects to support early proposal/estimate/feed work, (b) construction specification allows PM's/construction coordinators to specify and communicate during early planning and project execution, (c) constructability bulletin notification—communication for information and awareness that a solution exists and is ready for deployment; and vi) Sustainability—scaffolding suppliers will evolve and improve the technology.

The systems and methods also reduce i) supply chain demand and energy associated with manufacturing and shipping scaffolding materials; and ii) fuel demand (scaffolding material will ship on existing trucks, no extra trucks are needed). A typical adjustable metal scaffold could, for example, cost $50,000 or more for a 11.6 m tank. The scaffold is entirely customized, and most parts cannot be used on different diameter tanks. By contrast, the systems and methods disclosed herein would cost $2,126 per year for a 11.6 m tank and may include just one custom part, which can be used with conventional scaffold parts on all tanks regardless of tank size and configuration and allows customization in the field with existing scaffold parts.

The systems and methods thus, improve the overall process for accessing elevated field erected structures on construction projects such as, for example, field erected storage tanks, LNG tanks, and LNG spheres. The systems and methods may also be applied to non-tank scopes such as, for example, concrete walls with external structural steel and piping, structural steel racks, pipe racks and other elevated work projects as required.

While the present disclosure has been described in connection with presently preferred embodiments, it will be understood by those skilled in the art that it is not intended to limit the disclosure of those embodiments. For example, the systems described herein may be implemented in new system scaffold access applications or retrofitted to a conventional scaffold system. Further, the system described herein may be implemented in other access solution systems to achieve similar results. It is therefore, contemplated that various alternative embodiments and modifications may be made to the disclosed embodiments without departing from the spirit and scope of the disclosure.

The invention claimed is:

1. A scaffold securing device comprising:

a base adapted to be secured to a fixed surface, the base having a planar face and a support member substantially perpendicular to the planar face, the support member forming an upper extension and a lower extension at a predetermined distance from the planar face;

a coupler for temporarily coupling the scaffold to the base, the coupler having a planar face, a first restraining side, a second restraining side and an adapter affixed to the planar face for temporarily securing the coupler to the scaffold, the first restraining side and the second restraining side being substantially perpendicular to the planar face and separated by a support arm fixed between the first restraining side and the second restraining side for supporting the coupler on the support member of the base and a removable restraining arm coupled to the first restraining side and the second restraining side below the support arm for enabling coupling and decoupling between the scaffold and the base; and wherein the securing device enables movement between the base and the coupler for securing the scaffold to a linear surface or different curvilinear surfaces.

2. The scaffold securing device of claim 1, wherein the upper extension and the lower extension of the support member form a combined length that is longer than a distance between the support arm and the restraining arm of the coupler for limiting movement of the coupler away from the base and maintaining coupling between the scaffold and the base.

3. The scaffold securing device of claim 1, wherein the support member extends a predetermined distance away from and substantially perpendicular to the planar face to enable movement between the base and the coupler.

4. The scaffold securing device of claim 1, wherein the first restraining side and the second restraining side are spaced apart a predetermined distance to enable movement between the base and the coupler.

5. The scaffold securing device of claim 1, wherein the adapter is a hook or a clip adapted to support and secure the scaffold.

6. The scaffold securing device of claim 1, wherein the removable restraining arm passes through an opening in the first restraining side and an opening in the second restraining side.

7. The scaffold securing device of claim 6, wherein the removable restraining arm is coupled to the first restraining side and the second restraining side by a cotter pin passing through an opening at one end of the removable restraining arm.

8. The scaffold securing device of claim 7, wherein the removable restraining arm includes a handle at another end opposite the one end with the opening.

9. The scaffold securing device of claim 1, wherein the different curvilinear surfaces include cylindrical surfaces and spherical surfaces.

10. The scaffold securing device of claim 1, wherein the base is adapted to be secured to a fixed surface by welding portions of the planar face to the fixed surface.

11. The scaffold securing device of claim 1, wherein the adapter is affixed to the planar face by welding.

12. A method for securing a scaffold, comprising:

securing a base to a fixed curvilinear surface;

securing a coupler to the scaffold, the coupler having a planar face, a first restraining side, a second restraining side and an adapter affixed to the planar face for securing the coupler to the scaffold; and coupling the scaffold to the base with the coupler by adjusting the coupler based on the fixed curvilinear surface while the scaffold is coupled to the base.

13. The method of claim 12, wherein the scaffold is coupled to the base above a ground surface.

14. The method of claim 12, wherein the base includes a planar face and a support member substantially perpendicular to the planar face, the support member forming an upper extension and a lower extension at a predetermined distance from the planar face.

15. The method of claim 14, wherein the first restraining side and the second restraining side are separated by a support arm fixed between the first restraining side and the second restraining side for supporting the coupler on the support member of the base.

16. The method of claim 15, wherein the first restraining side and the second restraining side are separated by a removable restraining arm coupled to the first restraining side and the second restraining side below the support arm for enabling coupling and decoupling between the scaffold and the base.

17. The method of claim 14, wherein the upper extension and the lower extension of the support member form a combined length that is longer than a distance between the support arm and the restraining arm of the coupler for limiting movement of the coupler away from the base and maintaining coupling between the scaffold and the base.

18. The method of claim 14, wherein the support member extends a predetermined distance away from and substantially perpendicular to the base to enable movement between the base and the coupler.

19. The method of claim 12, wherein the first restraining side and the second restraining side are spaced apart a predetermined distance to enable movement between the base and the coupler.

20. The method of claim 12, wherein the fixed curvilinear surface is a cylindrical surface or a spherical surface.

* * * * *